US009394720B2

(12) United States Patent
Goldwitz

(10) Patent No.: US 9,394,720 B2
(45) Date of Patent: Jul. 19, 2016

(54) TENSIONING AND SECURING MECHANISM FOR STRUCTURE COVERS

(75) Inventor: Brian Goldwitz, West Haven, CT (US)

(73) Assignee: New England Outdoor & Recreational Products, LLC, West Haven, CT (US)

( * ) Notice: Subject to any disclaimer, the term of this patent is extended or adjusted under 35 U.S.C. 154(b) by 230 days.

(21) Appl. No.: 13/072,491

(22) Filed: Mar. 25, 2011

(65) Prior Publication Data

US 2011/0232713 A1 Sep. 29, 2011

Related U.S. Application Data

(60) Provisional application No. 61/317,298, filed on Mar. 25, 2010.

(51) Int. Cl.
*E04H 15/32* (2006.01)
*E04H 15/64* (2006.01)

(52) U.S. Cl.
CPC ..... *E04H 15/32* (2013.01); *E04H 15/64* (2013.01); *Y10T 24/34* (2015.01)

(58) Field of Classification Search
CPC ..... E04H 15/32; E04H 15/34; E04H 15/54; E04H 15/64; F16G 11/10; F16G 11/101; F16G 11/12; F16G 11/143; B60P 3/079; B60P 7/04; Y10T 24/34
USPC ..... 135/121, 123, 115, 119, 120.4, 905, 135/907; 52/2.25–2.26, 23, 63, 83; 24/300–302, 343, 136 R, 136 K, 115 H, 24/115 K, 115 R; 116/173–174; 248/154, 248/499, 500, 510, 328, 339
See application file for complete search history.

(56) References Cited

U.S. PATENT DOCUMENTS

| | | | | | |
|---|---|---|---|---|---|
| 928,469 | A * | 7/1909 | Miles | 135/118 |
| 1,522,644 | A * | 1/1925 | Munson | 135/99 |
| 1,884,449 | A * | 10/1932 | Wickstrum | 135/138 |
| 2,385,716 | A * | 9/1945 | Mahaffey | 135/120.4 |
| 2,856,941 | A * | 10/1958 | O'Neal | 135/137 |
| 3,044,476 | A * | 7/1962 | Avery | 135/156 |
| 3,095,069 | A * | 6/1963 | Winkler | 135/123 |
| 3,718,947 | A * | 3/1973 | Huber | 24/298 |
| 3,891,257 | A * | 6/1975 | Wilson | 292/262 |
| 5,050,924 | A * | 9/1991 | Hansen | 296/100.15 |
| 5,117,853 | A * | 6/1992 | Pruesner | 135/121 |
| 5,560,384 | A * | 10/1996 | Oh | 135/115 |
| 5,634,483 | A * | 6/1997 | Gwin | 135/131 |
| 5,655,340 | A * | 8/1997 | Pelsue | 52/71 |
| D415,572 | S * | 10/1999 | Goldwitz | D25/56 |
| 6,155,280 | A * | 12/2000 | Powell et al. | 135/124 |
| 6,247,484 | B1 * | 6/2001 | Thomas | 135/123 |
| 6,564,817 | B1 * | 5/2003 | Tseng | 135/119 |
| 6,966,324 | B2 * | 11/2005 | Guido | 135/120.4 |
| 6,994,099 | B2 * | 2/2006 | Goldwitz | 135/122 |
| 7,306,417 | B2 * | 12/2007 | Dorstewitz | 410/100 |
| 7,963,295 | B2 * | 6/2011 | Li | 135/94 |
| 8,156,952 | B2 * | 4/2012 | Chesness | 135/123 |
| 2002/0164940 | A1 * | 11/2002 | Maxwell | 452/125 |

* cited by examiner

*Primary Examiner* — Winnie Yip
(74) *Attorney, Agent, or Firm* — Loza & Loza, LLP; Julio Loza

(57) ABSTRACT

A fastening mechanism for temporary structures with a frame with one or more attachment points disposed therein, a rope, a cover configured with one or more sleeves through which the rope may be inserted, one or more fasteners for securing the rope to the attachment points, and a pass-through loop pre-configured in the rope, such that a further loop can be formed by passing a section of the rope through the pass-through loop.

16 Claims, 10 Drawing Sheets

TENSIONING AND SECURING MECHANISM FOR STRUCTURE COVERS

CROSS REFERENCE TO RELATED APPLICATIONS

This non-provisional United States (U.S.) patent application claims the benefit of provisional U.S. Patent Application No. 61/317,298, filed Mar. 25, 2010, entitled "Tensioning And Securing Mechanism For Structure Covers", and which is hereby incorporated by reference.

FIELD OF INVENTION

At least some features relate to a mechanism for securing canvas or covers to removable or temporary structures.

BACKGROUND OF INVENTION

Removable or temporary structures are designed for easy deployment. Such structures typically comprise a frame and a cover that wraps around the top and perhaps some sides of the structure. Due to the removable or temporary nature of such structures, attaching the cover to the frame should be a simple task for an installer to perform. Yet, the cover should be securely and tightly attached to the frame.

Removable or temporary structures can be used for many purposes. In particular, these structures are useful during disaster relief operations. If they are comfortable to live in, easy to set up, and durable, they provide a convenient instant shelter for all types of scenarios. This type of shelter is perfect for refugee use, providing safety and shelter in impoverished areas.

A canopy structure, in which an outer covering or canopy is disposed over a lightweight internal frame makes an excellent temporary structure. It is necessary, however, to provide some method to attach the canopy to the frame, typically by utilizing a tensioned rope. Use of mechanical ratchets and similar devices to provide tensioning in the rope add to the cost of the structure, making it less feasible to deploy these structures during disaster relief operations.

Therefore there is and continues to be a need for an improved and relatively inexpensive means to tension a rope to attach a canopy to a supporting internal frame structure.

SUMMARY OF INVENTION

The invention meets this need by providing a fastening mechanism for temporary structures, comprising a frame with a first attachment point disposed therein, a rope with a first section and a second section, a cover configured with a sleeve capable of having the rope inserted therein, a pass-through loop pre-configured in the second section of the rope, such that a first loop can be formed by passing the second section of the rope through the pass-through loop; and a first fastener capable of being attached to the first loop, the first fastener for securing to the first attachment point.

In a further embodiment, the first section of the rope is pre-inserted in the cover sleeve. In a still further embodiment, the first fastener is pre-attached to the first loop, and in an alternate embodiment a first loop is pre-formed by passage of the second section of the rope through the pass-through loop.

In another embodiment a second attachment point is disposed in the frame and a second fastener capable of being attached to the rope is provided, the second fastener for securing to the second attachment point. In a further embodiment the second fastener is pre-attached to the rope. In an alternate embodiment the first section of the rope has an inserted portion and an exposed portion, the inserted portion is pre-inserted in the sleeve, and the exposed portion is outside the sleeve. In a still further embodiment the cover has two ends and one or more sides, and the sleeve comprises two end sleeves, each having a length, and each disposed along one end of the cover.

Advantageously, the cover has been sized to overhang the frame, and the fasteners are made of a single piece of metal.

In another embodiment a single tensioning mechanism is used at each end, while in a further embodiment, two tensioning mechanisms are used at each end.

Alternatively, the cover is configured with a plurality of sleeves, further comprising a plurality of attachment points disposed in the frame and a plurality of fasteners for securing to the respective attachment point are provided, wherein the first section of the rope has inserted portions and exposed portions, the inserted portions are pre-inserted in the sleeve, and the exposed portions are outside the sleeve, and one of the plurality of fasteners is pre-attached to each of the exposed portions of the rope.

A temporary structure kit is also disclosed, having a plurality of component parts, comprising a frame with one or more attachment points disposed therein, a rope having inserted portions and exposed portions, a cover configured with one or more sleeves, wherein the inserted portions of the rope have been pre-inserted in one of the one or more sleeves, one or more fasteners, each pre-attached to one of the one or more exposed portions of the rope and each capable of being secured to a respective attachment point, one or more pass-through loops have been pre-formed in the rope, one or more first loops have been pre-formed by passing the second section of the rope through one of the pass-through loops, and one or more loop fasteners have been pre-attached to the each of the first loops, the loop fastener capable of being secured to an attachment point.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

Figure 1:
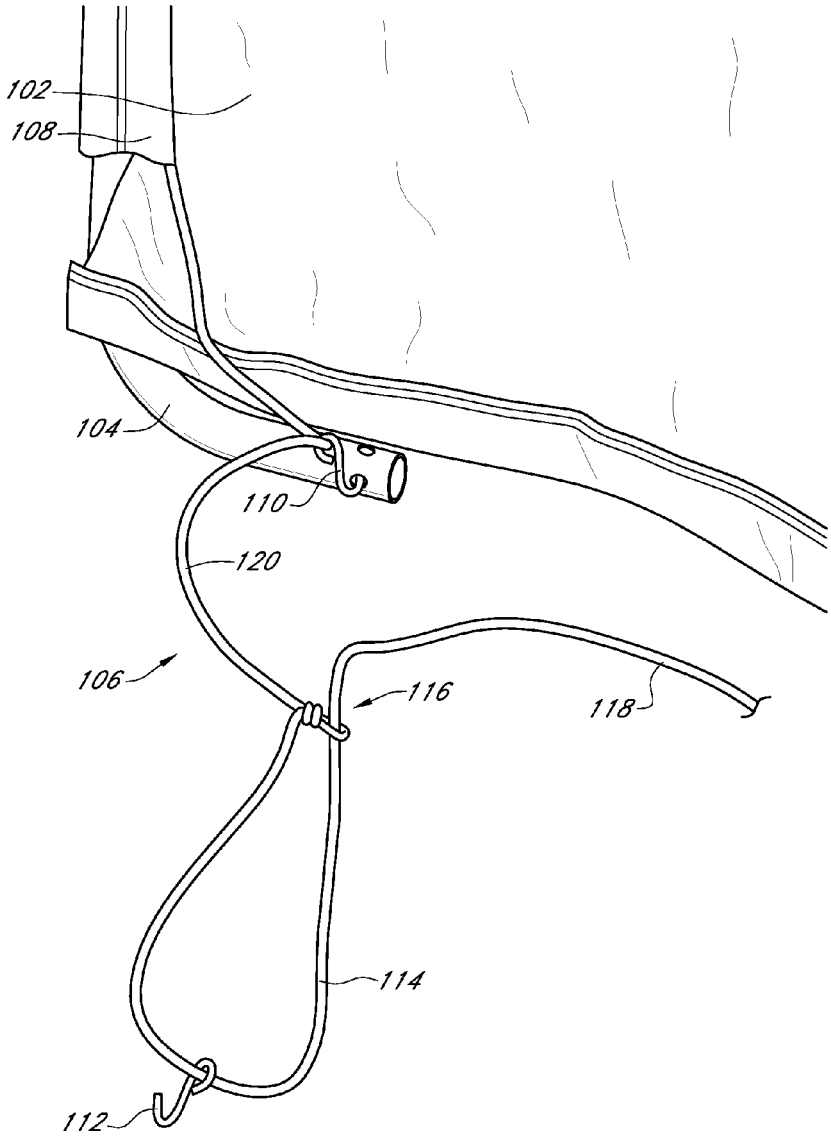
FIG. 1 illustrates one embodiment of the invention used to attach a cover to a frame.
Figure 2:
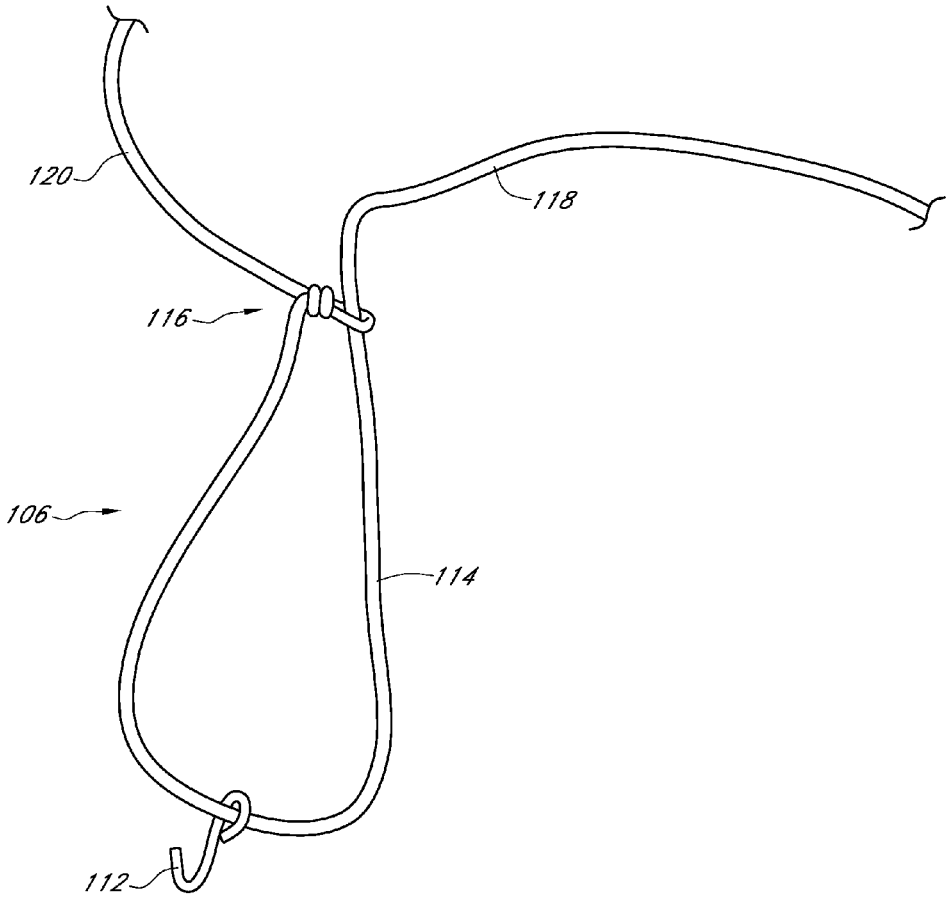
FIG. 2 is a close-up view of a portion of the embodiment shown in FIG. 1.

The following detailed description is of the best currently contemplated modes of carrying out the present invention.

The description is not to be taken in a limiting sense, but is made merely for the purpose of illustrating the general principles of the invention.

Embodiments of the invention are directed to a fastening mechanism for removable or temporary structures.

FIGS. 1-7 illustrate how a securing system may be used to tighten a cover 102 to a frame 104 having attachment points disposed therein, by using a rope 106 that has been reeved, or passed through, a sleeve 108 in the edge of the cover 102. The rope 106 may include a first attachment fastener 110 and a second attachment fastener 112. The attachment fasteners shown in the drawings are "S-type" but any type of fastener would work, including "C-Type," as will be understood by one of ordinary skill in the art. A single piece of metal, bent into an appropriate shape, would work as a fastener, dispensing with the need to use more expensive ratchets. The rope 106 may be pre-configured to include a first loop 114 formed between a first section 120 and a second section 118. A pass-through second loop 116 is formed from the rope 106 so that one end of the rope 106 passes the second loop 116 to form the first loop 114.

Advantageously, the sleeve 108 will be sufficiently small so that any loops are prevented from passing through the sleeve.

The attachment points are openings in the frame into which a fastener may be inserted. Advantageously, the attachment points may be configured to receive the attachment fastener chosen. For example, a single or double hole attachment point would mate well with "S-type" and "C-type fasteners. The location of the attachment points in the frame is a design choice, and any location will work, provided that it affords sufficient travel so that the rope may be adequately tensioned. Advantageously, the attachment points are positioned roughly as indicated in the drawings. From FIG. 6, it can be appreciated that if the sides of the cover are above the attachment point, then the rope is pulled down to tighten. From FIG. 9, it can be appreciated that if the sides of the cover are below the attachment point, then the rope is pulled up to tighten. Multiple attachment points could be disposed in one or more poles, to allow use of different attachment points as needed.

The cover may extend down one or more side walls of the structure, providing further enclosure. Advantageously, the cover will be sized to overhang the structure on all sides in order for the tensioning mechanism to work properly, so that when tensioned the cover will wrap around the structure, providing additional rigidity. Further covering, as will be understood by one of ordinary skill in the art, such as by zippers or other mechanisms, could be added to the ends of the structure, to provide further enclosure. Advantageously, the cover could be treated to withstand various environmental hazards, such as ultraviolet radiation. Openings and netting could be disposed in the cover in order to allow air and light to enter the shelter.

It will be understood by one of ordinary skill in the art that many different configurations of frame structure could be used with the invention. The frame could be constructed from a variety of materials, as will be understood by those of ordinary skill in the art, including PVC pipe and galvanized steel. Advantageously, the frame could be designed to slip and lock together with no special tool requirements. The frame itself could be supported in the ground by fasteners, or by partial burial, in order to further stabilize the structure.

Figure 3:
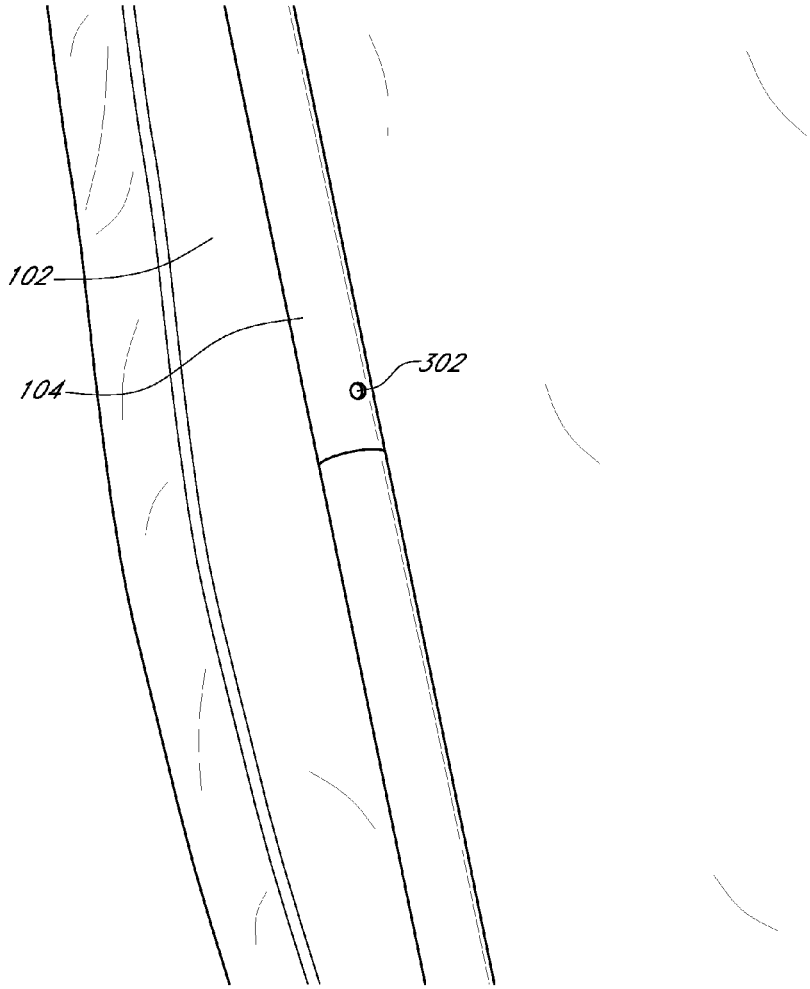
FIG. 3 illustrates a second attachment point used in the embodiment shown in FIG. 1.

FIG. 3 illustrates an embodiment where a second attachment point 302 is disposed along a vertical member of the frame 104, where the second attachment point 302 is used to secure the second fastener 112.

Figure 4:
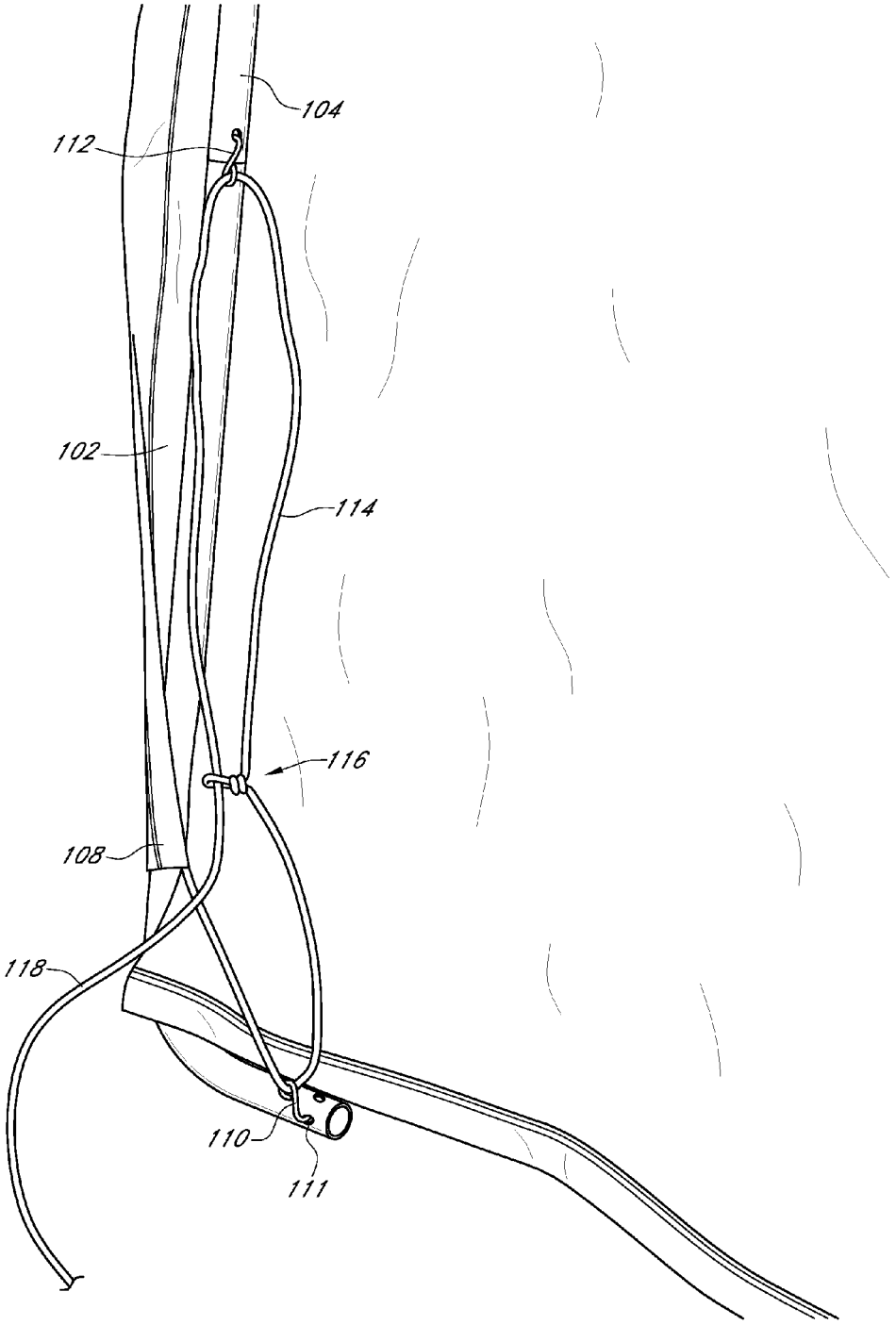
FIG. 4 is a further view of the embodiment shown in FIG. 1.

FIG. 4 illustrates how the first fastener 110 is coupled to a first attachment point 111 along a horizontal member of the frame 104, while the second fastener 112 is coupled to the second attachment point 302 along the vertical member of the frame 104. Note that the rope passes through a sleeve 108 along an edge of the cover 102. The cover 102 may come with the rope 106 pre-installed through the sleeve 108 and possibly the fasteners 110 and 112 also pre-attached to the rope 106. After the user has assembled the frame, the cover is placed over the top and/or sides of the structure. The first fastener 110 is then coupled to the first attachment point and the second fastener 112 is coupled to the second attachment point.

In a further embodiment, the rope could be reeved through a sleeve disposed along the side of the canopy in order to tension the structure longitudinally between the two ends. In such an embodiment, a tensioning mechanism could be provided for the ends of the cover on opposing poles, and one or more further tensioning mechanisms could be provided for the sides of the canopy on remaining poles. For example, assuming that there are 8 poles (supporting legs) in the frame, and looking at the structure from the top and proceeding clockwise, the poles on the right side could be numbered 1-4 and the poles on the left side could be numbered 5-8. Tensioning mechanisms could be provided on poles 1 (first support leg), 4 (second support leg), 5 (third support leg) and/or 8 (fourth support leg), to tension the ends of the cover. In such case a rope may be tensioned between pole 4 (second support leg) and pole 5 (third support leg), and/or between pole 1 (first support leg) and pole 8 (fourth support leg), and if the cover was sized to overhang the ends of the frame, and the tensioned ropes were reeved through sleeves as described herein, the cover would be pulled over the ends of the frame, providing structural rigidity to the entire frame. In one example, a securing fastener may be provided at one end of the rope while a tensioning mechanism may be provided at the opposite end of the rope. Further tensioning mechanisms, using one or more of the embodiments described herein, could then be provided on one or more remaining poles, with the reeved portion along a side of the frame. By way of example, tensioning mechanisms according to one of the embodiments herein may be disposed on poles 1 (first support leg) and 5 (third support leg) to tension the cover ends, and further tensioning mechanisms and/or mere securing mechanisms may be provided on poles 4 (second support leg) and 8 (fourth support leg) to tension those respective sides.

A further embodiment, tensioning mechanisms could be provided for two sides of a rope. For example, using the pole numbering described in the preceding paragraph, a tensioning mechanism could be provided on both pole 1 (first support leg) and pole 8 (fourth support leg), allowing the introduction of tension to the rope from both sides of the rope.

Figure 5:
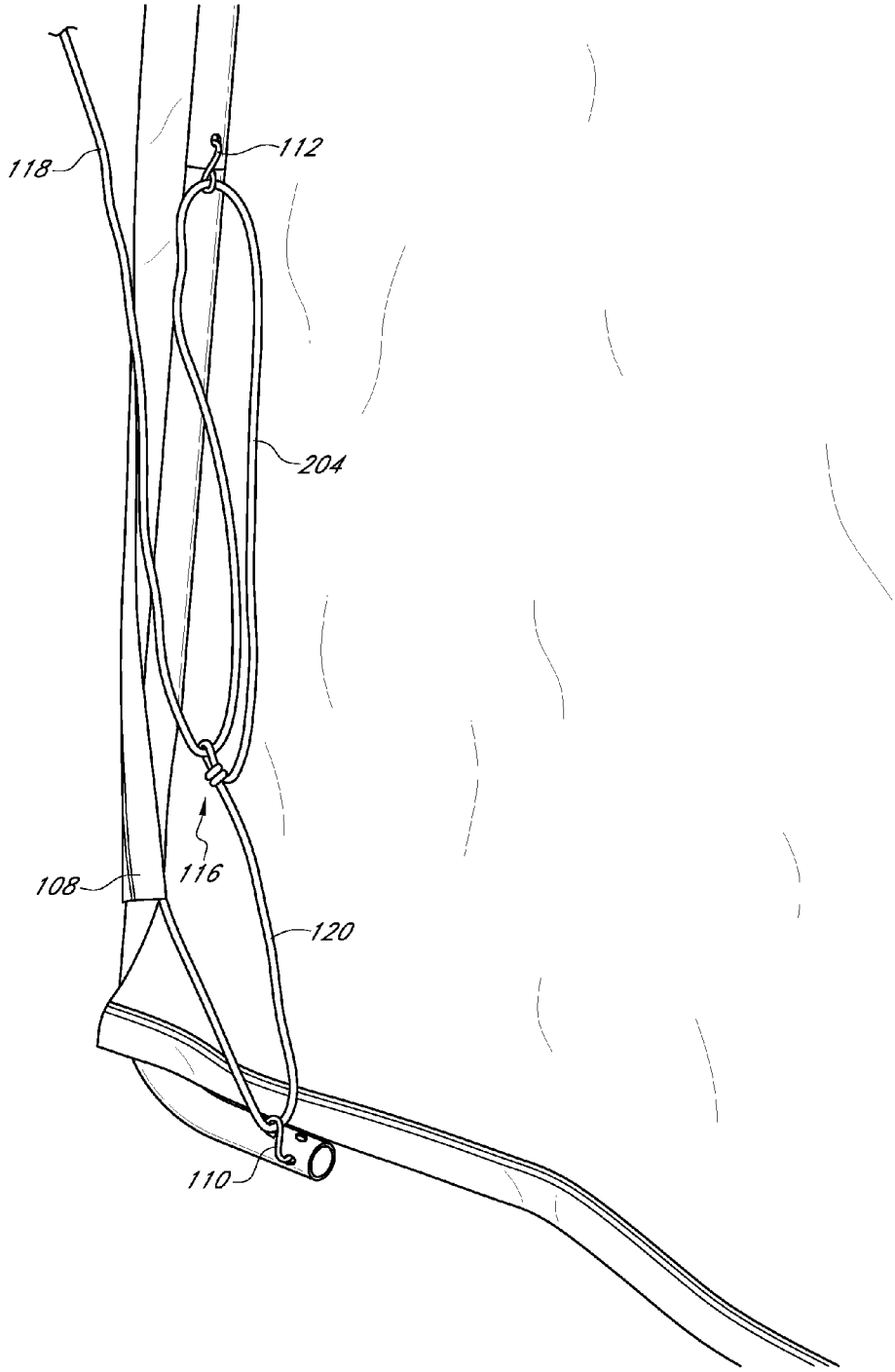
FIG. 5 is a further view of the embodiment shown in FIG. 1.
Figure 6:
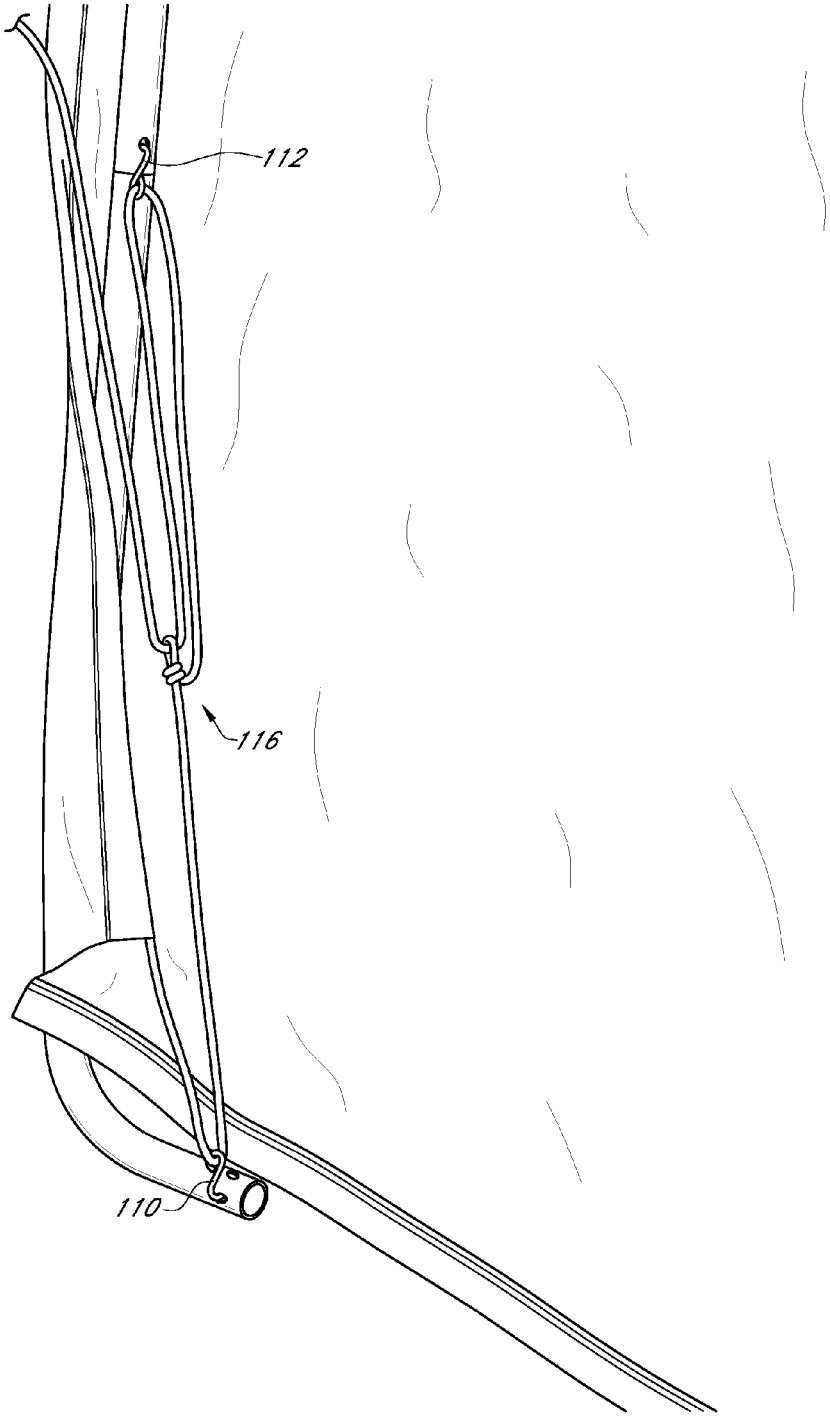
FIG. 6 is a further view of the embodiment shown in FIG. 1.

FIGS. 5 and 6 illustrate how the second section 118 (i.e., the end of the rope 106) is then pulled to tighten the cover around the frame 104 of the structure. The second section 118 may then be secured to the vertical frame, for example, by many methods, as will be understood by one of ordinary skill in the art, in order to prevent the loosening of the rope, including the use of cleats and chocks.

Note that the pre-configured rope 106 (i.e., with fasteners 110 and 112 and pass-through loop 116) allows for easy installation and tightening of the cover 102 around the frame 104. By pulling the second section 118 upward, the rope 106 (and consequently the cover 104) are tightened around the frame 104, without the use of mechanical ratchets. Note that the tensioning mechanism (comprising the pre-configured rope 106 with fasteners 110 and 112 and pass-through loop 116) not only pulls and/or tightens the cover over the frame structure but it also pulls and/or tightens along a longitudinal direction (i.e., to tighten the sides).

Figure 7:
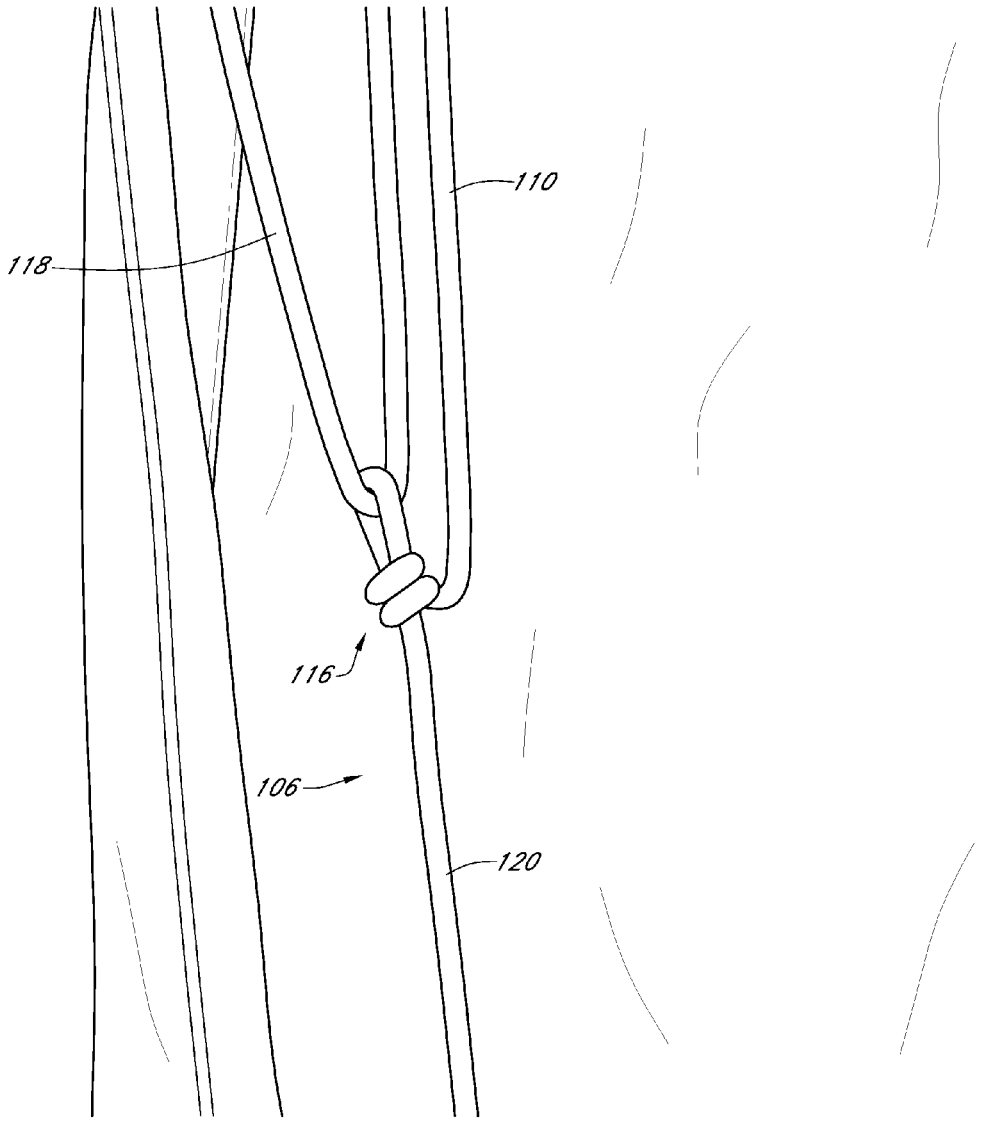
FIG. 7 is a close-up view of a portion of the embodiment shown in FIG. 1.

FIG. 7 is a close-up view of the pass-through loop 116 and the sections of the rope 106. This view illustrates how the second section 118 is allowed to slide through the pass-through loop 116 to tighten the rope 106 and cover 102.

Figure 8:
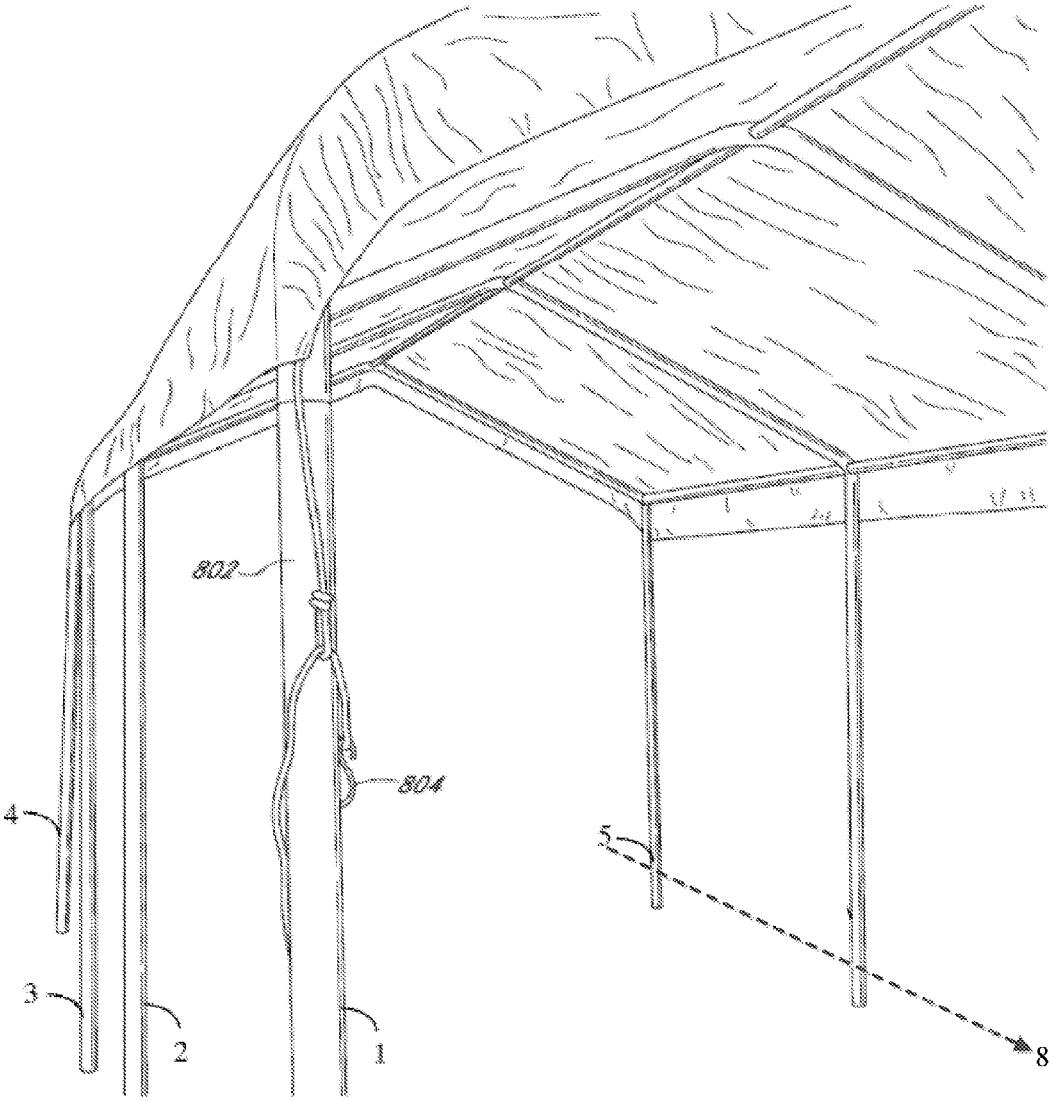
FIG. 8 illustrates another embodiment of the invention.
Figure 9:
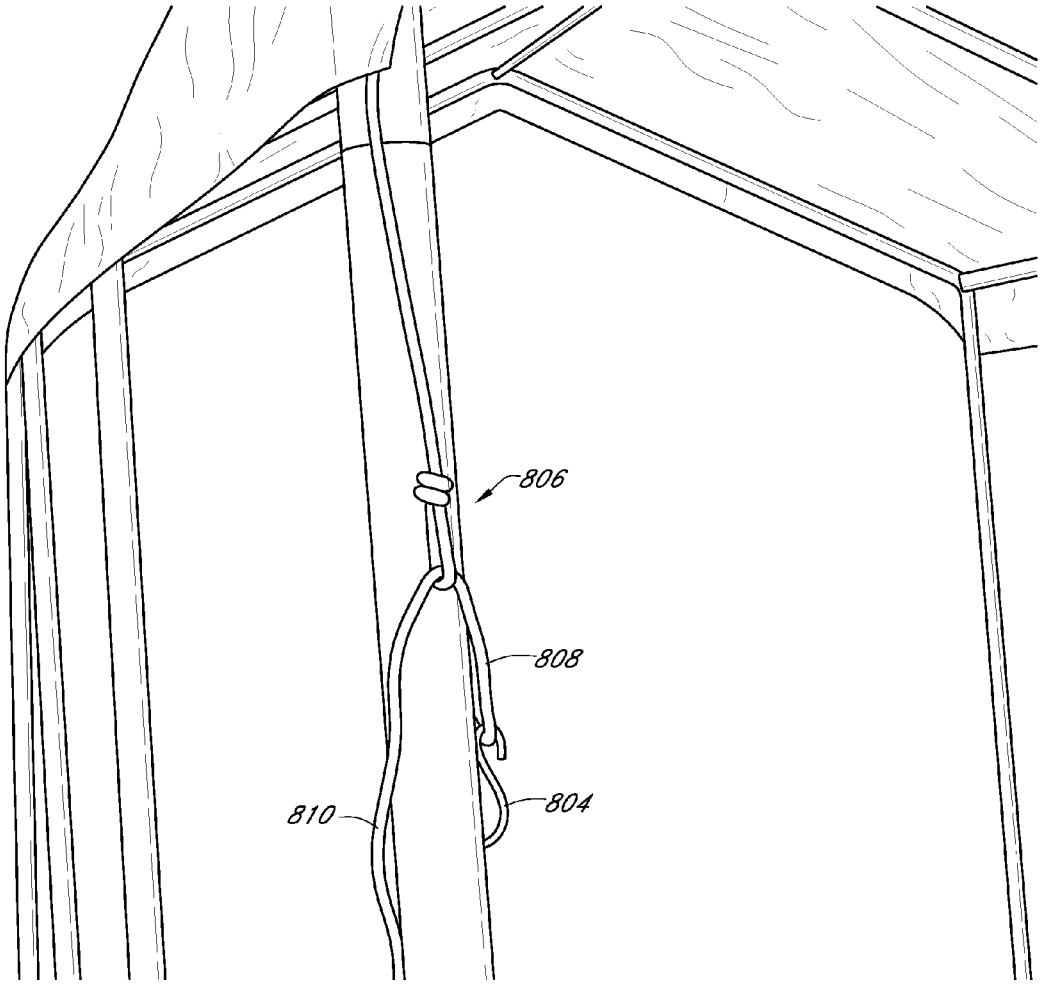
FIG. 9 is a close-up view of the embodiment shown in FIG. 8.
Figure 10:
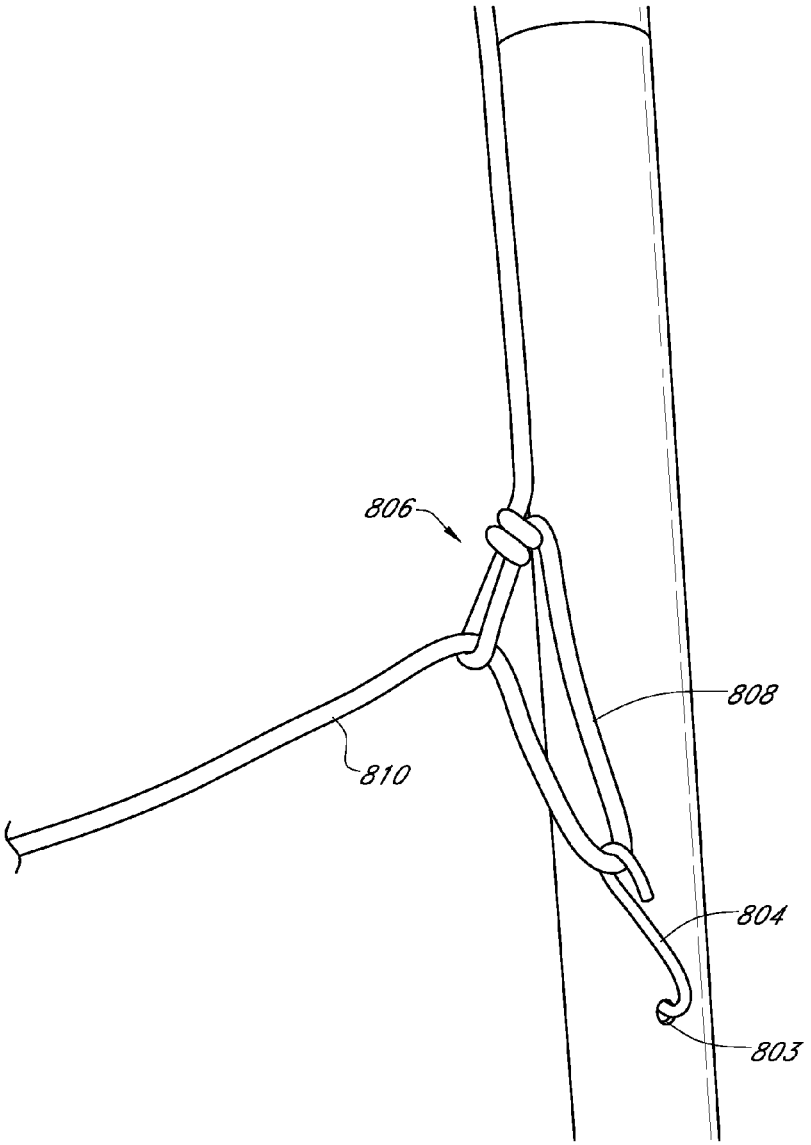
FIG. 10 is a close-up view of the embodiment shown in FIG. 8.

FIGS. 8-10 illustrate a second type of structure which may also employ a variation of the pre-configured rope tightening system. In this example, the rope 802 has a single fastener 804 rather than two. The rope 802 is configured with a pass-through second loop 806, a larger first loop 808 formed by passing a second section 810 of the rope through the second loop 806. Note that rope 802 passes through sleeves in the cover to cause it to tighten the cover around a structure frame. By selecting the location of the second loop 806 and attachment point 803 for the fastener 804, this permits a user to tighten the rope sufficiently to cause the cover to tighten around the structure frame (i.e., tighten in all directions).

Tightening of the rope is accomplished, with reference to FIGS. 8-10, by pulling downward on rope section 810, placing rope section 802 under tension. In the embodiments shown in FIGS. 1-7, tightening of the rope is accomplished by pulling upward on rope section 118, placing rope section 120 under tension.

In any of the embodiments, after the rope has been appropriately tensioned to secure the cover to the frame, any remaining rope (e.g., sections 118 or 810) may be secured to the frame by any method, as will be understood by one of ordinary skill in the art, in order to prevent the loosening of the rope, including the use of cleats and the like.

In each of the embodiments, use of pre-configured loops in the rope, pre-installed rope in the sleeves, and pre-attached fasteners, will facilitate ease of construction, which is particularly suited for disaster relief operation. In some embodiments, when the rope is pre-installed in the sleeve, the one or more loop(s) of the rope prevent the rope from being pulled back out through the sleeve and being separated from the cover. Further, packaging of these items in a kit would alleviate logistical problems and allow for rapid introduction of the completed structures. Elimination of the use of metal ratchets further facilitates mass deployment of these structures, due to decreased per-unit cost.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art. Therefore, it is to be understood that, within the scope of the appended claims, the invention may be practiced other than as specifically described herein.

What is claimed is:

1. A pre-configured fastening kit for temporary structures, comprising:

a frame (104) with a first attachment point (803) disposed therein;

a pre-configured single continuous rope (106) with a first section (120) and a second section (118);

a cover (102) configured with a sleeve (108) having the pre-configured single continuous rope inserted therein;

a pass-through loop (116) formed in the second section (118) of the pre-configured single continuous rope, a first loop (114) defined by passage of the second section (118) of the rope through the pass-through loop (116); and a first fastener (112) attached through the first loop (114), the first fastener (112) being secured to the first attachment point for securing the first loop to the first attachment point (302, 803) on the frame to provide a non-rotating tension to the rope to tighten the cover.

2. The pre-configured fastening kit of claim 1, wherein the first section of the rope is inserted in the cover sleeve.

3. The pre-configured fastening kit of claim 2, wherein the first fastener is attached to the first loop.

4. The pre-configured fastening kit of claim 1, further comprising a second attachment point disposed in the frame and a second fastener attached to the rope, the second fastener for securing to the second attachment point.

5. The pre-configured fastening kit of claim 1, wherein the first section of the rope has an inserted portion and an exposed portion, the inserted portion is inserted in the sleeve, and the exposed portion is outside the sleeve.

6. The pre-configured fastening kit of claim 5, where the cover has been sized to overhang the frame.

7. The pre-configured fastening kit of claim 5, the cover having two ends and one or more sides, wherein the sleeve comprises two end sleeves, each having a length, and each disposed along one end of the cover.

8. The pre-configured fastening kit of claim 1, where the first fastener is a single piece of metal.

9. The pre-configured fastening kit of claim 1, wherein the preconfigured single continuous rope comprises a non-elastic material.

10. A temporary structure kit having a plurality of component parts, comprising:

a frame (104) with one or more attachment points (111, 302) disposed therein;

a pre-configured rope being a single continuous rope (106) having inserted portions and exposed portions;

a cover (102) configured with one or more sleeves (108), wherein the inserted portions of the pre-configured rope (106) are inserted in one of the one or more sleeves (108);

one or more fasteners (110, 112), each attached to one of the one or more exposed portions of the pre-configured rope (106) and each secured to a respective attachment point (111, 302);

one or more pass-through loops (116) formed in the exposed portions of the pre-configured rope;

one or more first loops (114) formed by passage of one or more of the exposed portions of the pre-configured rope through the one or more of the pass-through loops (116); and one or more loop fasteners attached to the each of the first loops (114), the loop fastener secured to one of the other attachment points, wherein the pre-configured rope provide a non-rotating tension configured to tighten the cover in both a horizontal and vertical directions.

11. The kit of claim 10, where each fastener is a single piece of metal.

12. The kit of claim 11, where the cover has been sized to overhang the frame.

13. The kit of claim 12, the cover having two ends and one or more sides, wherein the one or more sleeve comprises two end sleeves, each having a length, and each disposed along one end of the cover.

14. A pre-configured fastening kit for temporary structures, comprising:

a frame (104) with four or more poles, two of which are disposed at a proximal end of the frame and two of which are disposed at a distal end;

a plurality of attachment points (111, 302), one or more of which is disposed in opposing proximal and distal end poles;

two pre-configured ropes, each being a single continuous rope with a first section (120) and a second section (118);

a cover (102), sized to overhang the frame (104), having two ends and two sides, wherein the cover (102) comprises two end sleeves (108), each having a length, and each disposed along one end of the cover (102), and each sleeve (108) having one of the pre-configured ropes inserted therein;

a pass-through loop (116) formed in the second section (118) of each pre-configured rope, a first loop (114) defined at each rope by passage of the second section (118) of the respective rope through the respective pass-through loop (116); and a fastener (112), made of a single piece of metal, attached to each first loop (114), and securing the first loop to one of the attachment points (302) on the frame, wherein the two pre-configured ropes provide a non-rotating tension configured to concurrently tighten the cover in both a horizontal and vertical directions.

15. The pre-configured fastening kit of claim 14, in which the first section of each pre-configured rope passes through the entire length of a sleeve.

16. The pre-configured fastening kit of claim 14, wherein the attachment points are disposed in all proximal and distal end poles.

* * * * *